US006123089A

United States Patent [19]

Fish

[11] Patent Number: 6,123,089

[45] Date of Patent: Sep. 26, 2000

[54] ADJUSTABLE KNEE SUPPORT

[76] Inventor: Richard I. Fish, 6477 Robert St., West Palm Beach, Fla. 33413

[21] Appl. No.: 09/294,736

[22] Filed: Apr. 19, 1999

[51] Int. Cl.[7] ..... A61H 3/00

[52] U.S. Cl. ..... 135/67; 297/5

[58] Field of Search ..... 135/65–67; 297/5

[56] References Cited

U.S. PATENT DOCUMENTS 3,596,668 8/1971 Tosto .
4,722,356 2/1988 Rehder .
5,086,798 2/1992 Motts .
5,291,909 3/1994 Skorman et al. .

*Primary Examiner*—Beth A. Stephan
*Attorney, Agent, or Firm*—McHale & Slavin

[57] ABSTRACT

A adjustable knee support device for use with a walker employs a support platform, at least one positioning assembly, and a bracing assembly. The positioning assembly includes at least one connector construction and at least one bolstering construction. The connector construction and bolstering constructions are adjustable, allowing the height of the support platform to be changed. The support platform may be alternately used to provide left leg support and right leg support, as needed. The bracing assembly is pivotally attached to the support platform and automatically adjusts to ensure that the device is maintained securely in any chosen orientation. The device may be attached and removed without tools or modification to an existing walker.

10 Claims, 4 Drawing Sheets

ADJUSTABLE KNEE SUPPORT

FIELD OF THE INVENTION

This invention is directed to walking assistance devices generally, and, in particular, to an adjustable knee support device useable with existing and newly-manufactured walkers.

BACKGROUND OF THE INVENTION

Upright trusses or frames, commonly-known as "walkers" are often used to provide assistance for individuals who need assistance walking from place to place. These "walker" devices are typically used by individuals who do not need a wheelchair, but for whom the support provided by a cane is insufficient.

Walkers are usually three-sided, substantially-rectangular upright frames that allow an individual to maintain balance, while using both arms to help support his weight. Due to their three-sided nature, walkers not only provide support, they also help steady individuals who use them.

Although crutches are also available, crutches do not typically help steady those who use them. While crutches provide a certain amount of support, successful use of crutches requires a degree of balance and strength not possessed by all patients. As a result, many individuals find a walker to be a more comfortable and safe alternative.

However, for some individuals, although a wheelchair is not necessary, a conventional walker does not provide enough support. For example, individuals who have below-the-knee injuries may wish to use a walker instead of crutches or a wheelchair. However, conventional walkers do not allow the individual to remove weight from the injury or injuries. Several leg and knee supporting devices have been developed expressly for use by individuals who must remove weight from a portion of one leg. Many of these devices supplement existing walkers, either as add-on pieces or as original equipment included during manufacture.

For example, U.S. Pat. No. 3,596,668 discloses a padded tray that removably hooks onto crossbars of an existing walker. The reference discloses separate pads, one to support a left leg and one to support a right leg. The pad height is not adjustable and one pad cannot be transferred from one side to the other.

U.S. Pat. No. 4,722,356 discloses a knee pad attachment for use with a walker. The '356 attachment includes a height-adjustable support pad. And the pad pivots to support either a right leg or a left leg. However, the '356 pad is adjusted by loosening a pivoting central sleeve. Locking the pad in place requires hand strength that may not be possessed by all who might use the device. If the '356 device were used without being properly secured, the pad could swing about presenting a hazardous, unstable situation. Even if the '356 pad were properly secured initially, the pad could work dangerously-loose with continued loading and unloading. Ironically, the '356 device may eliminate one problem only to create another.

U.S. Pat. No. 5,086,798 presents a walker having an adjustable knee rest. The rest may be moved from one side to another, and the height may also be adjusted. Although the '798 device may be used to accommodate both legs, tools are required to switch from one to the other. Additionally, extra bolt holes must be drilled to use the rest on an existing walker. The need to drill extra holes may make the '798 device unusable for individuals who are renting a walker, those who do not have access to drilling tools, and those who lack the mechanical inclination or dexterity necessary to drill such holes.

U.S. Pat. No. 5,291,909 discloses an adjustable walker leg support device. The '909 device presents a leg support that is highly-adjustable, allowing for changes in support angle and overall height. The '909 is designed to be attached at a variety of locations within a given walker. However, the high degree of adjustability requires vigilance during installation. The high degree of complexity makes the '909 difficult to mount securely and adjust efficiently.

Thus, what is needed is a walker knee support that includes advantages of the known devices, while addressing the shortcomings they exhibit. The knee support should be simple to install and remove, while still permitting a high degree of adjustability. The device should be useable for either leg and be equally stable in either orientation. The device should be easy to install on both new walkers and existing walkers, requiring no tools or modifications to the walker. The device also should include not only an attachment assembly that connects the device to a walker, but also a bracing assembly that fixes the device in a selected orientation within the walker, once the device is attached. The device should also not interfere with original adjustment capabilities of an existing walker, including overall walker height adjustment and walker folding capabilities. The device should also securely hold detached walker leg lower portions, so that the lower portions are readily available for reattachment when the device is no longer to be used.

SUMMARY OF THE INVENTION

The instant invention is a knee support device useful for attachment to a walker. The device allows a person to rest a leg bent at the knee upon a padded platform adjustably fixed within the walker. By resting his leg in this manner, the individual can distribute his weight between both arms and both legs, even though one leg may be injured.

The present invention employs a support platform that is adjustably joined to an existing walker via a pair of positioning assemblies. Each positioning assembly includes at least one connector construction and at least one bolstering construction. The connector constructions link the support platform to an existing walker, engaging either pair of walker side legs. Each of the bolstering constructions extends downward between the support platform and the ground. The bolstering constructions allow an individual to place his weight upon the device. The knee support device of the present invention also employs a bracing assembly that cooperates with the positioning assemblies to ensure the support platform is held securely within the walker, regardless of platform position within the walker. Both the bracing assembly and the positioning assemblies are advantageously adjustable without tools or walker modification, yet their cooperative nature allows the support platform to be positioned securely in several orientations, as desired. The support platform height within the walker may be adjusted, and the support platform may be easily removed or moved from one side of the walker to the other. The device allows continued overall walker height adjustment.

Thus, an objective of the instant invention is to provide a walker knee support device that is simple to install and remove, while still permitting a high degree of an objective of the instant invention is to provide a walker knee support device that is adjustable.

An additional objective of the instant invention is to provide a walker knee support device that is useable for either leg at various heights, while be equally stable in all orientations.

A further objective of the instant invention is to provide a walker knee support device that is easy to install on both new walkers and existing walkers, requiring no tools or modifications to the walker.

Yet another objective of the instant invention is to provide a walker knee support device that includes not only an attachment assembly that connects the device to a walker, but also a bracing assembly that fixes the device in a selected orientation within the walker, once the device is attached.

Still a further objective of the instant invention is to provide a walker knee support device that cooperates with original adjustment properties of an existing walker, including overall walker height adjustment and walker folding capabilities.

An additional objective of the instant invention is to provide a walker knee support device that securely holds detached walker leg lower portions, keeping the lower portions readily available for reattachment when the device is no longer to be used.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 2:
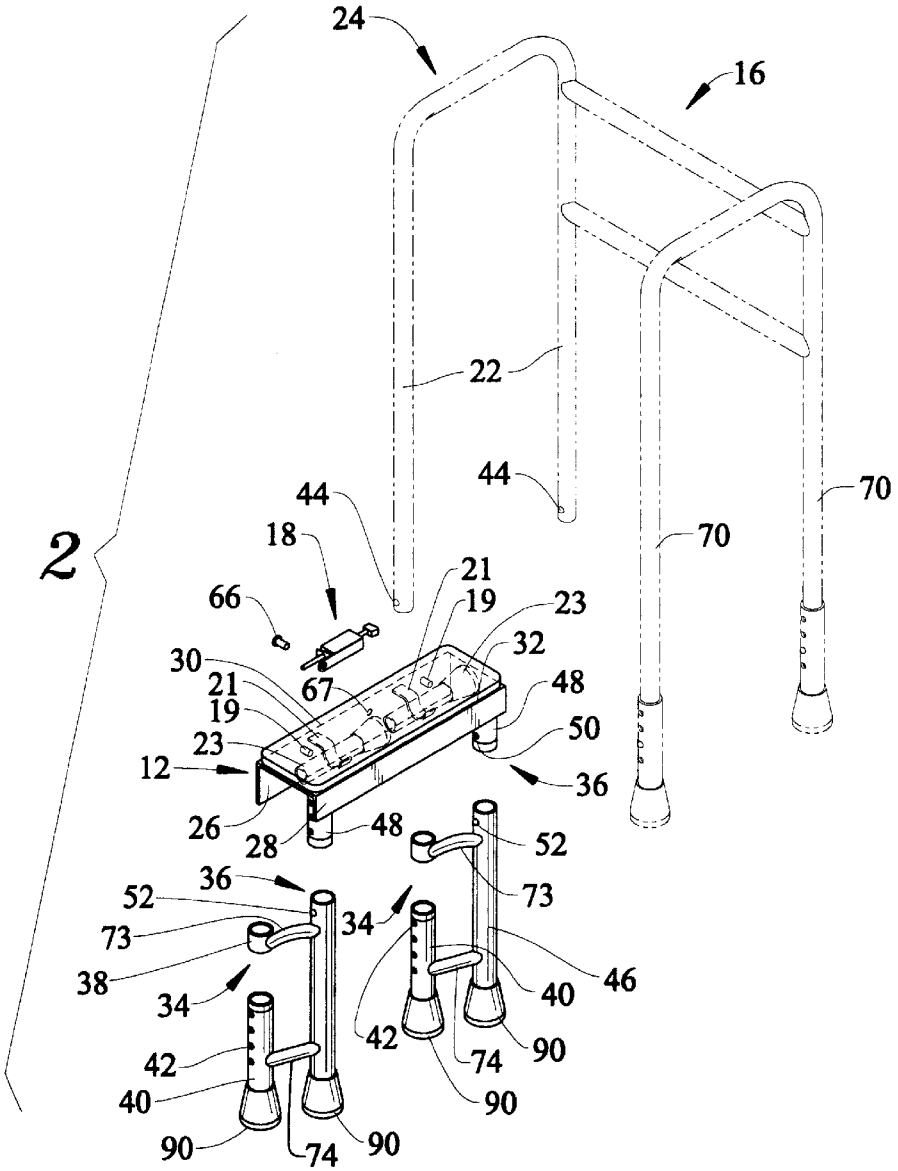
FIG. 2 is an exploded view of the knee support device shown in FIG. 1.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 1:
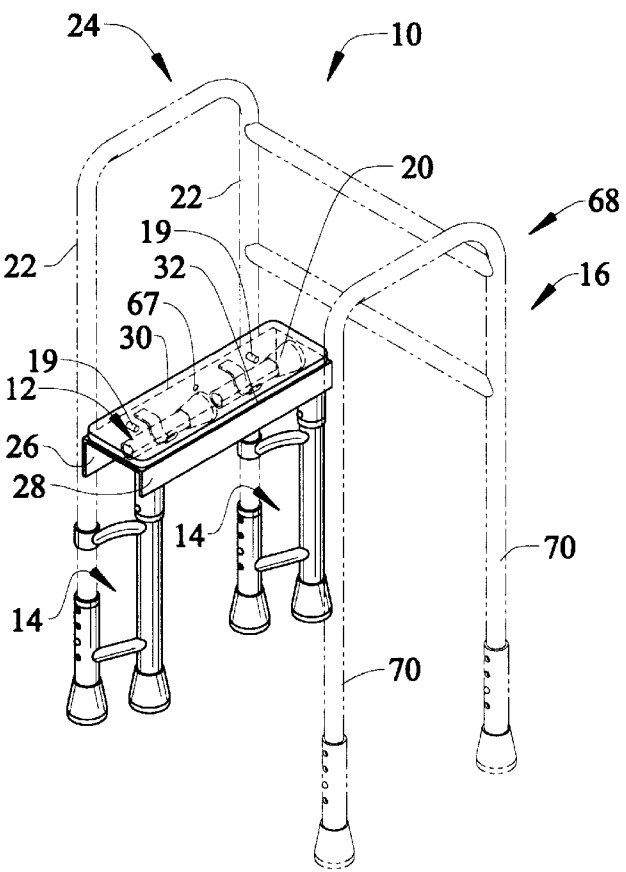
FIG. 1 is a pictorial view of the knee support device of the present invention shown in use on an existing walker.

Now with reference to FIGS. 1 and 2, the knee support device 10 of the present invention is shown. By way of overview, the device 10 includes a support platform 12 that is held place by a pair of positioning assemblies 14. The positioning assemblies 14 allow vertical adjustment of the device 10 with respect to an existing walker 16. An included bracing assembly 18 supplements the positioning assemblies 14 to ensure that the support platform 12 remains in a chosen orientation with respect to the walker 16. The knee support device 10 will now be discussed in detail.

With continued reference to FIGS. 1 and 2, the support platform 12 included in the knee support device 10 is sized and shaped to accommodate the bent leg of an individual, not shown. More specifically, the support platform 12 includes a padded main panel 20 that, during use, is oriented transverse to a first pair of legs 22 which characterize the first side 24 of the walker 16. In addition to the main panel 20, the support platform 12 also includes a pair of reinforcement panels 26,28. The first reinforcement panel 26 extends orthogonally downward from a first side edge 30 of the support platform main panel 20 and abuts the first side legs 22. The second reinforcement panel 28 extends downward from a main panel second side edge 32. The reinforcement panels 26,28 increase the stiffness of the support assembly 12. Although the knee support device may be made to function without these reinforcement panels 26,28, their presence is preferred; the reinforcement panels help the device resist torsional and bending loads. Holding clips 21, mounted under the main panel 20, removably maintain walker leg bottom sections 23 that have been detached to allow use of the present knee support device 10 and the lower receiving sleeves 40 associated therewith. In this manner, the leg bottom sections 23 may be secured to the device 10 in an unobtrusive location, ready for easy re-installation when the device is no longer needed.

With continued reference to FIG. 1, the support platform 12 is attached to the walker 16 by positioning assemblies 14. As shown in FIG. 2, each of the positioning assemblies includes a connector construction 34 and a bolstering construction 36. In a preferred embodiment, the connector constructions 34 are comprised of upper and lower receiving sleeves 38,40 that cooperatively engage one of the walker first legs 22. The lower receiving sleeves 40 each include a first series of locking apertures 42 that cooperate with a first spring-loaded locking pin 44 extending radially from within the walker leg 22. The locking pin 44 may be allowed to engage any one of the locking apertures 42, thereby permitting selective height adjustment of the walker 16. It is noted that the relative locations of the pin 44 and apertures 42 may be reversed, if desired. Additionally, although a preferred embodiment of the connector constructions 34 includes the adjustable pin-and-aperture arrangement discussed above, other methods of adjustment may be used, as appropriate. For example, sections of the receiving sleeves 38,40 and walker legs 22 may be threaded and adjustably screwed together. Relative position between the leg 22 and receiving sleeves 38,40 may also be maintained by bolts, not shown, passing through the sleeves to frictionally engage the legs.

In a preferred embodiment, each of the bolstering constructions 36 is a two-piece assembly, including a support post 46 and an attachment sleeve 48. Each attachment sleeve 48 extends downward from the main panel 20 and includes a second series of locking apertures 50. In turn, each support post 46 includes a second spring-loaded locking pin 52 that extends radially from within the support post. As with the first set of locking apertures 42 and the first locking pin 44, the second locking pin 52 will engage a selected locking aperture 50 from within the second series thereof. The second set of locking apertures 50 and second locking pin 52 cooperatively allow secondary vertical adjustment of the support platform 12 with respect to the walker legs 22. It is noted that the relative locations of the pin 44 and apertures 42 may also be reversed. Although a preferred embodiment of the bolstering constructions 36 includes the adjustable pin-and-aperture arrangement discussed above, other methods of adjustment may be used, as desired. For example, sections of the attachment sleeves 48 and support posts 46 may be threaded and adjustably screwed together. Relative position between the posts 46 and attachment sleeves 48 may also be maintained by bolts, not shown, passing through the sleeves to frictionally engage the legs.

Figure 3:
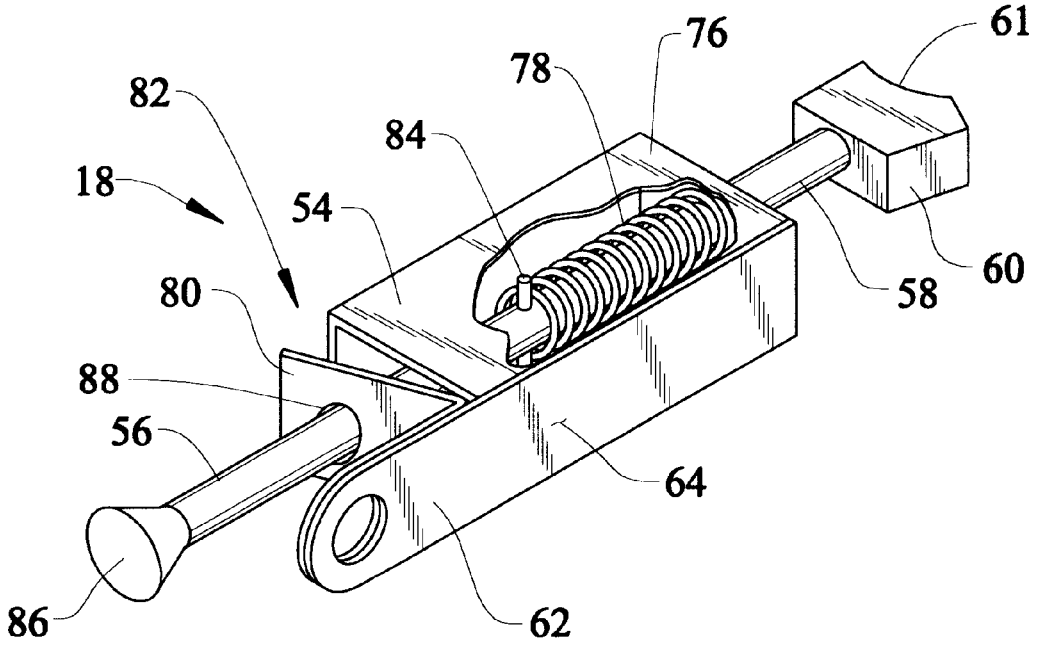
FIG. 3 is a perspective view of the bracing assembly used in the knee support device of the present invention, with an included biasing spring compressed.
Figure 4:
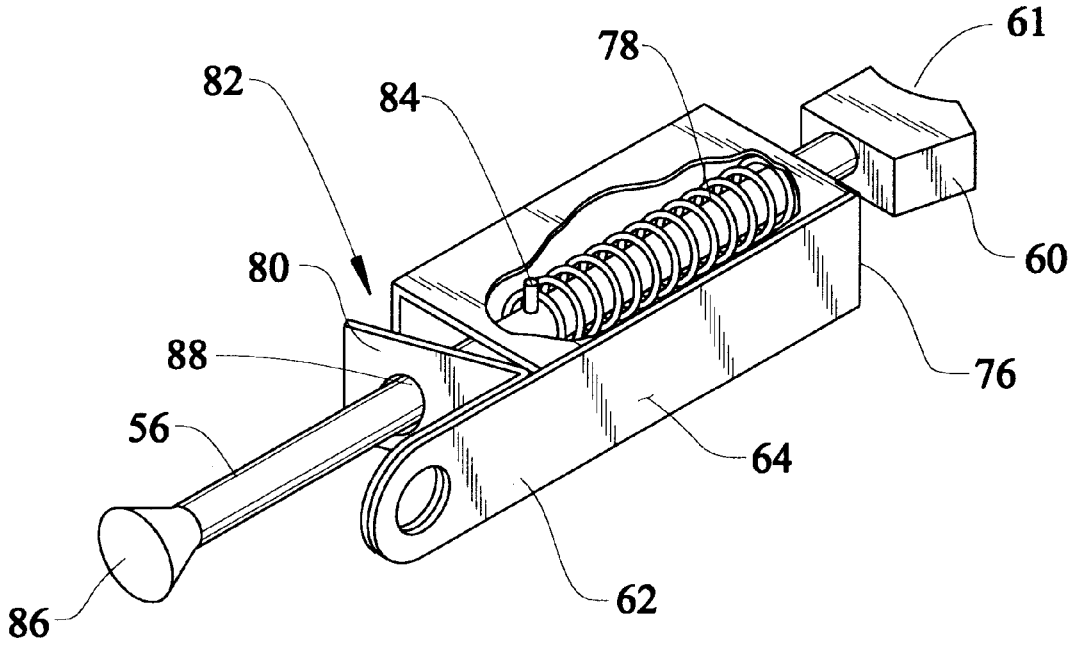
FIG. 4 is a perspective view of the bracing assembly used in the knee support device of the present invention, with an included biasing spring at rest.

With reference to FIGS. 3 and 4, the bracing assembly 18 will now be described. The bracing assembly 18 includes a substantially-hollow housing 54. The housing 54 includes a proximal end 82 and an opposite distal end 76; a rigid plunger 56 slidably extends axially through the housing. An attachment flange 62 extends along a walker-leg-facing side 64 of the housing 54, and the bracing assembly 18 is pivotally attached to the first reinforcement panel 26 by a mounting bolt 66 that passes simultaneously through the attachment flange 62 and a bolt aperture 67, located in the first reinforcement panel. With this arrangement, the bracing assembly 18 is able to pivot through one-hundred-eighty degrees, thereby allowing the leg-engaging surface 61 to selectively engage either of the walker first legs 22. Stop pins 19 disposed on the first reinforcement panel 26 prevent unwanted downward pivoting of the bracing assembly 18.

The distal end 58 of the plunger 56 is characterized by a contoured securing foot 60. In a preferred embodiment, the securing foot 60 is rubber and has a curved, leg-engaging surface 61 shaped to securely hold the outer wall of one of the walker legs 22. The plunger proximal end 86 is flared and allows comfortable positioning of the plunger 56 within the housing 54.

Positioning of the plunger 56 and the attached securing foot 60 is controlled by a cooperative arrangement between a biasing spring 78, disposed within the housing 54, and a locking tab 80 associated with the proximal end 82 of the housing. More specifically, the biasing spring 78 extends between the housing distal end 76 and an attachment post 84 mounted on the plunger 56. The biasing spring 78 tends to urge the distal end 58 the plunger 56 toward the proximal end 82 of the housing 54. However, motion of the plunger 56 toward the housing proximal end 82 is checked by the locking tab 80. The locking tab 80 is essentially a rigid panel flexibly associated with the proximal end 82 of the housing 54. The locking tab 80 is characterized by a passthrough aperture 88 having a diameter that approximates the diameter of the plunger 56. The ease with which the plunger 56 slides through the locking tab 80 changes as a function of the relative orientation between the locking tab 80 and the plunger 56 passing therethrough. As the biasing spring 78 begins to shift the plunger distal end 58 toward the housing proximal end 82, the locking tab 80 bends toward the attachment flange 62. As the locking tab 80 bends toward the attachment flange 62, the perimeter of the passthrough aperture 88 binds against the exterior of the plunger. With continued motion of the plunger 56 through the passthrough aperture 88, the friction therebetween increases. Quickly, the friction between the plunger 56 and the aperture 88 increases to a level that overcomes the spring constant of the biasing spring 78, and the plunger becomes locked in place. Unlocking the plunger 56 is achieved by pushing the locking tab 80 to pivot the tab toward the proximal end 82 of the housing 54. With this arrangement, the bracing assembly 18 is adjustably self-tightening and ensures that the device 10 is securely fastened in any chosen orientation.

In preparation for use, the support platform 12 is put into place by inserting the ends of walker legs 22 into the receiving sleeves 38,40; the first locking pin 44 is then placed within an appropriate one of the first locking apertures 42. Once the receiving sleeves 38,40 have engaged the walker legs 22 at an appropriate height, the attachment sleeves 48 are aligned with the support posts 46, and the support platform 12 is lowered into place. As mentioned above, the relative height of the support platform 12 is adjusted by inserting the second locking pin 52 into an appropriate one of the second series of apertures 50.

Figure 5:
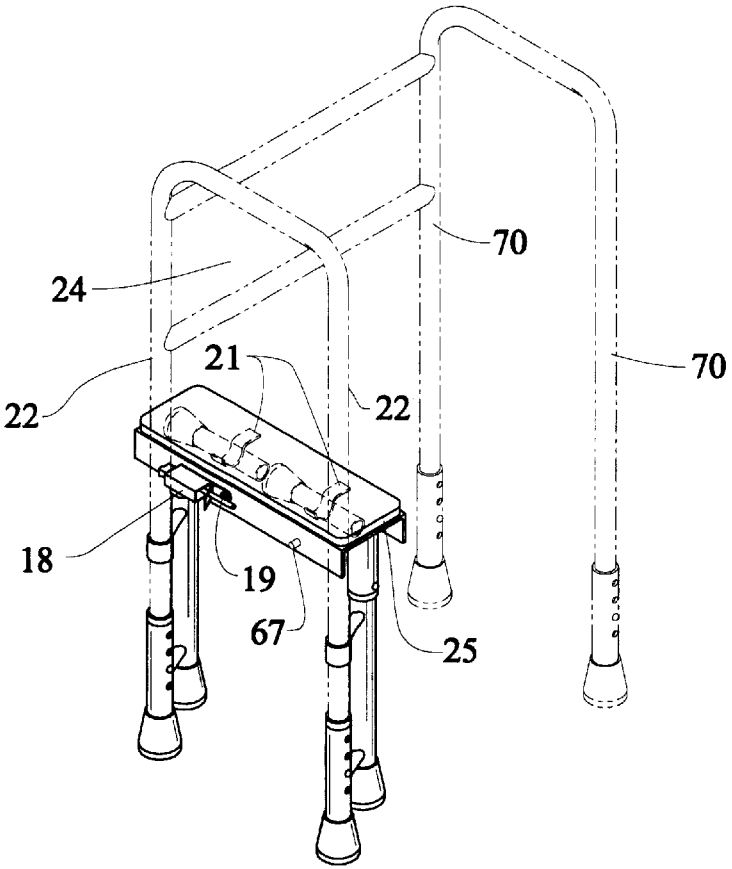
FIG. 5 is a pictorial view of the knee support device of the present invention attached to a first side of an existing walker, to support the left leg of an individual.

As shown in FIG. 5, once the support platform 12 is in place, with edge 25 facing rearwardly the bracing assembly 18 is pivoted into a perpendicular orientation with respect to one of the walker legs 22. The proximal end 56 of the plunger 56 is pushed to slide the plunger within the housing 54, thereby forcing the securing foot 60 against a chosen one of the walker legs 22. With the securing foot 60 resting against the leg 22, the plunger is released. As the biasing spring 78 begins to slide the plunger 56, the locking tab 80 binds against the plunger 56, and the securing foot 60 remains selectively locked against the walker leg 22. Slack between the securing foot 60 and the walker leg 22 may be eliminated by forcing the securing foot leg-engaging surface 61 against the walker leg while pulling the locking tab 80 away from the housing proximal end 82. In essence, pulling the locking tab 80 away from the housing proximal end 82, until the passthrough aperture 88 binds against the plunger 56, "pre-locks" the plunger in place, so that no plunger movement occurs when the plunger is released. The locking tab 80 feature of the present invention advantageously allows the device 10 to be mounted securely at a variety of heights on walkers 16 having various sizes and shapes.

Although the preferred embodiment of the device includes the automatic locking tab 80 arrangement described above, other methods of securing the plunger could also be used, if desired. For example, the plunger 56 could be held in place by a friction clip, not shown, removably attached to the plunger between the securing foot 60 and the housing distal end 76 after the securing foot has been forced into place. This arrangement would prevent unwanted sliding of the securing foot 60 away from the walker leg 22. Other suitable plunger-securing methods may also be used, if needed.

Figure 6:
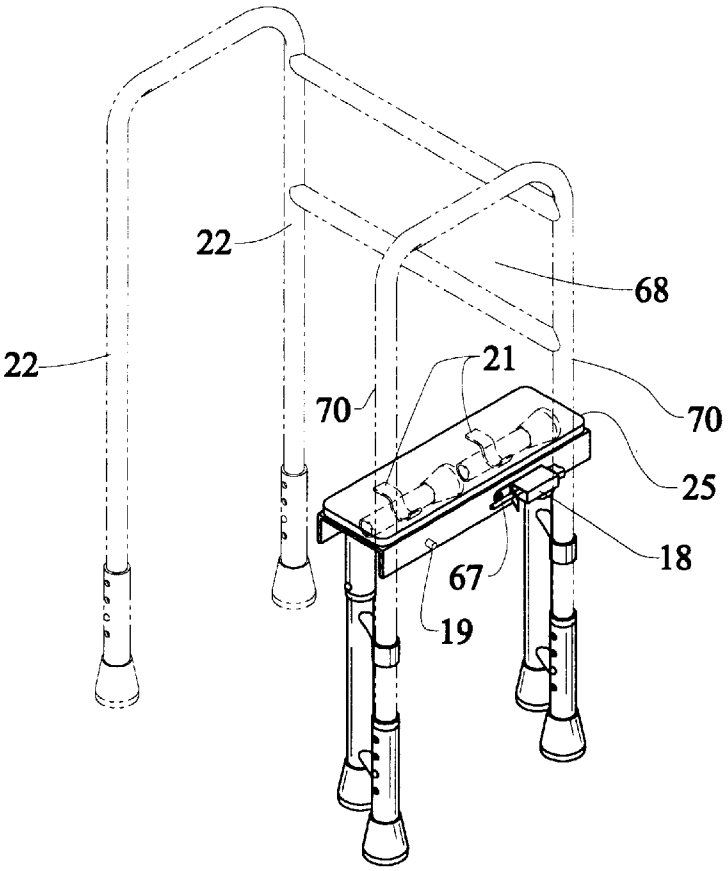
FIG. 6 is a pictorial view of the knee support device of the present invention attached to a second side of an existing walker, to support the right leg of an individual.

Although the knee support device 10 has been shown with the support platform 12 positioned to support an individual's left knee, the modular nature of the device 10 allows the placement of the support platform to be reversed. That is, the support platform 12 may be moved from the first side 24 of an existing walker 16 to the second side 68 of the walker. In keeping with the objectives of the present invention, the support platform 12 may alternatively be attached to a second pair of legs 70 that characterize the second side 68 of the walker 16 with edge 25 facing forward; this embodiment is shown in FIG. 6. In further keeping with the objectives of the present invention, the pivotal connection 66 used to mount the bracing assembly 18 holds the support assembly 18 securely in place on either side 24,68 of the walker 16. Moreover, the pivoting nature of the bracing assembly 18 ensures that the securing foot will engage the chosen walker leg 22,70 in a perpendicular orientation, thereby ensuring a snug fit.

As seen from the above discussion, with the knee support device 10 of the present invention, there is no need to modify an existing walker 16; no holes need be drilled, and assembly tools are not needed. Additionally, with respect to FIG. 1, the positioning assemblies include cushioned feet 90 to steady the walker 16 during use. Furthermore, as shown in FIG. 1, the support posts 46 are joined with the connector sleeves 38,40 via rigid linking rods 73,74 that extend therebetween.

Figure 8:
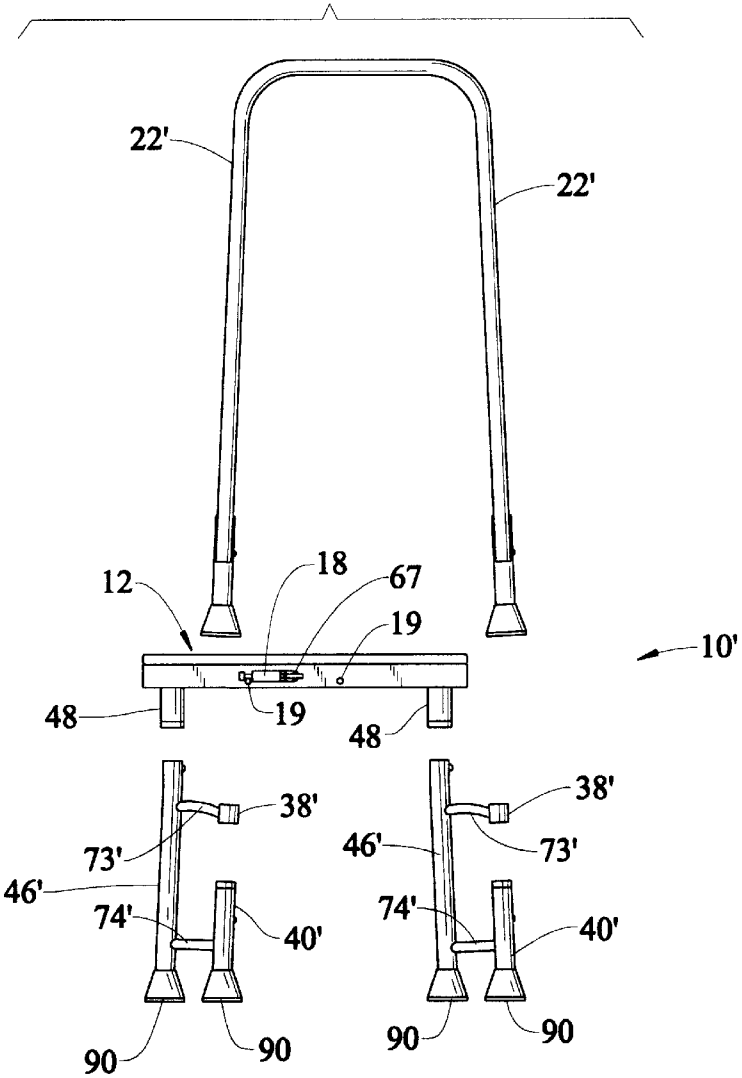
FIG. 8 is an exploded view of the knee support device shown in FIG. 7.
Figure 7:
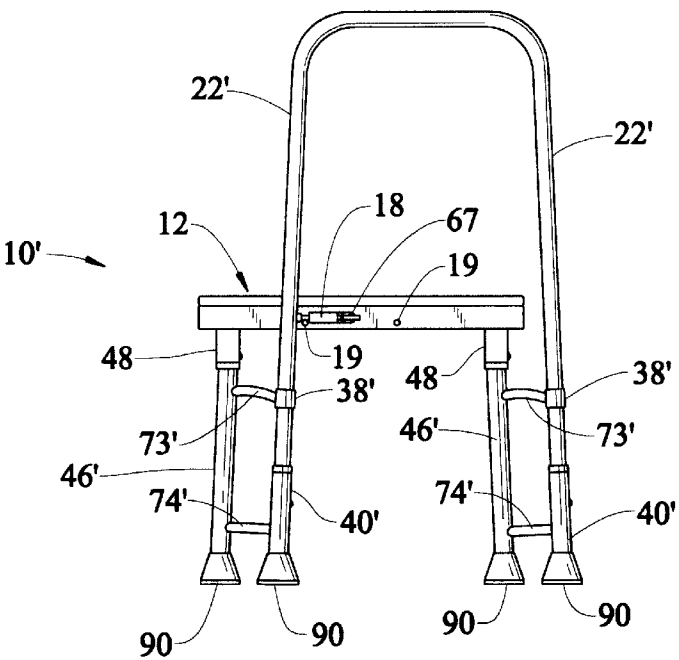
FIG. 7 is an elevation view of an alternate embodiment of the knee support device of the present invention.

In an alternate embodiment, shown in FIGS. 7 and 8, the knee support device 10' of the present invention is adapted for use with a walker having slanted legs 22'. In this embodiment, the upper and lower receiving sleeves 38',40' are angled to match the slope of the walker legs 22'; this is best seen in FIG. 7. The receiving sleeves 38',40 are linked to the support posts 46' via top and bottom linking rods 73,74, respectively. In this embodiment, the support posts 46' are modified so that the top portion is vertical, to engage attachment sleeves 48. The bottom portion of the support posts 46' is sloped, to match the slope of the walker legs 22'. Sloping the lower section of the support posts 46' facilitates the sloped orientation of the receiving sleeves 38',40', described above. This arrangement, advantageously allows height adjustment of the device 10', within a sloped-leg walker 16'. More particularly, as the device is adjusted, the upper portion of each support post 46' translates vertically within an associated attachment sleeve 48, and the now-sloped receiving sleeves 38',40' will travel along the sloped legs 22' of the walker 16'. Without this arrangement, the receiving sleeves 38,40' could not travel along the legs 22' of a sloped walker 16' without binding. Although many suitable leg slopes exist, a preferred slope is approximately 2.5 degrees from vertical.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A knee support device adapted for use with a walker, said walker having a first pair of upstanding legs forming a first side and a second pair of upstanding legs forming a second side, said knee support device comprising:

a support platform adapted to be selectively connected to said first side or said second side of said walker;

at least one positioning assembly; said at least one positioning assembly including a connector construction that is adapted to removably link said support platform to said first pair of upstanding legs for selectively connecting said support platform to said first side of said walker; said at least one positioning assembly including a bolstering construction for supporting the weight of an individual placed on said support platform during use; and a bracing assembly pivotally attached to said support platform, said bracing assembly having a securing member adapted to retractably extend from said support platform to one leg of said first pair of upstanding legs to selectively connect said support platform to said first side of said walker, said bracing assembly including a locking means for securing said securing member in an extended orientation against said one leg of said first pair of upstanding legs whereby when said support platform is selectively connected to said second side of said walker said connector construction is adapted to removably link said support platform to said second pair of upstanding legs and said bracing assembly pivots to a reverse position to selectively connect said securing member to said second pair of upstanding legs.

2. The knee support device according to claim 1, wherein:

said bracing assembly includes a plunger slidably associated with said support platform, said plunger being adapted at one end to frictionally engage an exterior surface of said one leg, said support member including a mounting flange extending therefrom, said mounting flange being pivotally attached to said support platform; and said locking means includes a locking tab hingedly attached to said support member, said locking tab being characterized by a passthrough aperture having a diameter substantially equal to the diameter of said plunger; and a biasing spring constructed and arranged to urge said plunger through said passthrough aperture, said biasing spring directing said plunger one end toward said locking tab, whereby as said biasing spring forces said plunger to slide through said passthrough aperture, said locking tab pivots with respect to an attachment flange and friction between said plunger and said locking tab increases until said plunger has traveled a terminal distance, wherein at said terminal distance said friction overcomes the spring constant of said biasing spring, thereby locking said plunger in place.

3. The knee support device according to claim 2, wherein said connector construction includes:

at least one receiving sleeve adapted to accept insertion of one leg of said selected pair of legs; and adjustment means for changing the distance said one leg is inserted into said receiving sleeve.

4. The knee support device according to claim 2, wherein said bolstering construction includes:

at least one support post adjustably extending downward from said support platform.

5. The knee support device according to claim 2, further including at least one holding clip adapted for removably securing a detached lower portion of one of said upstanding legs.

6. In a walking assistance device including a first pair of upstanding side support legs and a second pair of upstanding side support legs, said support legs being spaced apart by at least one crossbrace, the improvement including a knee support device comprising:

a support platform adapted to be removably linked to said first pair or said second pair of upstanding side support legs;

at least one positioning assembly; said at least one positioning assembly including a connector construction that is adapted to removably link said support platform to said first pair or said second pair of upstanding side support legs; said at least one positioning assembly including a bolstering construction that supports the weight of an individual placed on said support platform during use; and a bracing assembly pivotally attached to said support platform, said bracing assembly having a securing member adapted to retractably extend from said support platform to one leg of said first pair of upstanding side support legs and adapted to pivot approximately 180 degrees to retractable extend from said support platform to one leg of said second pair of upstanding side support legs, said bracing assembly including a locking means for securing said securing member in an extended orientation against said one leg.

7. The knee support device according to claim 6, wherein:

said bracing assembly includes a plunger slidably associated with said support platform, said plunger being adapted at one end to frictionally engage an exterior surface of said one leg, said support member including a mounting flange extending therefrom, said mounting flange being pivotally attached to said support platform; and said locking means includes a locking tab hingedly attached to said support member, said locking tab being characterized by a passthrough aperture having a diameter substantially equal to the diameter of said plunger; and a biasing spring constructed and arranged to urge said plunger through said passthrough aperture, said biasing spring directing said plunger one end toward said locking tab, whereby as said biasing spring forces said plunger to slide through said passthrough aperture, said locking tab pivots with respect to an attachment flange and friction between said plunger and said locking tab increases until said plunger has traveled a terminal distance, wherein at said terminal distance said friction overcomes the spring constant of said biasing spring, thereby locking said plunger in place.

8. The knee support device according to claim 7, wherein said connector construction includes:

at least one receiving sleeve adapted to accept insertion of one leg of said selected pair of legs; and adjustment means for changing the distance said one leg is inserted into said receiving sleeve.

9. The knee support device according to claim 7, wherein said bolstering construction includes:

at least one support post adjustably extending downward from said support platform.

10. The knee support device according to claim 7, further including at least one holding clip adapted for removably securing a detached lower portion of one of said upstanding legs.

* * * * *